US007936364B2

(12) United States Patent
Willis

(10) Patent No.: US 7,936,364 B2
(45) Date of Patent: May 3, 2011

(54) MAINTAINING BALANCE IN A DISPLAY

(75) Inventor: Thomas E. Willis, Mountain View, CA (US)

(73) Assignee: Intel Corporation, Santa Clara, CA (US)

( * ) Notice: Subject to any disclaimer, the term of this patent is extended or adjusted under 35 U.S.C. 154(b) by 1993 days.

(21) Appl. No.: 10/919,713

(22) Filed: Aug. 17, 2004

(65) Prior Publication Data

US 2006/0038808 A1 Feb. 23, 2006

(51) Int. Cl.
*G09G 5/10* (2006.01)

(52) U.S. Cl. ..... 345/691; 345/690; 345/204

(58) Field of Classification Search ..... 345/204, 345/691–693

See application file for complete search history.

(56) References Cited

U.S. PATENT DOCUMENTS

| | | | | |
|---|---|---|---|---|
| 6,072,448 | A * | 6/2000 | Kojima et al. | 345/63 |
| 6,664,977 | B1 | 12/2003 | Masumoto | |
| 6,833,832 | B2 * | 12/2004 | Wolverton | 345/532 |
| 2003/0137501 | A1 * | 7/2003 | Richards | 345/204 |
| 2003/0193514 | A1 * | 10/2003 | Huang | 345/694 |
| 2003/0201986 | A1 | 10/2003 | Willis et al. | 345/204 |
| 2004/0036707 | A1 | 2/2004 | Willis | 345/691 |
| 2004/0041825 | A1 | 3/2004 | Willis | 345/694 |
| 2004/0046752 | A1 | 3/2004 | Willis et al. | 345/204 |

FOREIGN PATENT DOCUMENTS

| | | |
|---|---|---|
| EP | 0 875 882 | 11/1998 |
| WO | WO 01/01386 | 1/2001 |

* cited by examiner

*Primary Examiner* — Alexander Eisen
*Assistant Examiner* — Jason M Mandeville
(74) *Attorney, Agent, or Firm* — Trop, Pruner & Hu, P.C.

(57) ABSTRACT

In one embodiment, the present invention includes a method of measuring a duration difference between a video frame and a corresponding modulation frame; and determining whether to change a duration of a future modulation frame based on the duration difference. The video frame and modulation frame may be part of a video stream and a modulation stream used to activate a display.

12 Claims, 5 Drawing Sheets

MAINTAINING BALANCE IN A DISPLAY

BACKGROUND

The present invention relates generally to displays, and more particularly, using pulse-width modulation to drive one or more display elements of an electro-optical display.

Pulse-width modulation (PWM) has been employed to drive liquid crystal (LC) displays. A pulse-width modulation scheme may control displays, including emissive and non-emissive displays, which may generally comprise multiple display elements. In order to control such displays, the current, voltage or any other physical parameter driving the display element may be manipulated. When appropriately driven, these display elements, such as pixels, normally develop light that can be perceived by viewers.

In an emissive display example, to drive a display (e.g., a display matrix having a set of pixels), electrical current is typically passed through selected pixels by applying a voltage to the corresponding rows and columns from drivers coupled to each row and column in some display architectures. An external controller circuit typically provides the necessary input power and data signal. The data signal is generally supplied to the column lines and is synchronized is to the scanning of the row lines. When a particular row is selected, the column lines determine which pixels are lit. An output in the form of an image is thus displayed on the display by successively scanning through all the rows in a frame.

For instance, a spatial light modulator (SLM) uses an electric field to modulate the orientation of an LC material. By the selective modulation of the LC material, an electronic display may be produced. The orientation of the LC material affects the intensity of light going through the LC material. Therefore, by sandwiching the LC material between an electrode and a transparent top plate, the optical properties of the LC material may be modulated. In operation, by changing the voltage applied across the electrode and the transparent top plate, the LC material may produce different levels of intensity on the optical output, altering an image produced on a screen.

Typically, a SLM, such as a liquid crystal on silicon (LCOS) SLM, is a display device where a LC material is driven by circuitry located at each pixel. For example, when the LC material is driven, an analog pixel might represent the color value of the pixel with a voltage that is stored on a capacitor under the pixel. This voltage can then directly drive the LC material to produce different levels of intensity on the optical output. Digital pixel architectures store the value under the pixel in a digital fashion, e.g., via a memory device. In this case, it is not possible to directly drive the LC material with the digital information, i.e., there needs to be some conversion to an analog form that the LC material can use.

A SLM such a LCOS SLM operates by applying a bias across the LC material to change the optical properties of the material. Due to the nature of the LC material, it must always be driven in a direct current (DC) balanced fashion; that is, the net bias across the material integrated over time must be zero.

Assuming the time over which the device modulates is constant, maintaining DC balance is straight forward. However, in real-world systems, this is often not the case. There are two primary reasons that DC balance is difficult to maintain. First, changes in the length of a video frame due to clock domain crossings as the data travels from the video source to the display can occur. Second, changes in the length of a video frame due to synchronization with a color management system for the display, such as a color wheel, can also occur.

In each of these cases, the display is confronted with a situation where there may be a slight jitter in a desired amount of time for which to modulate a give frame. In digital micro-displays such as a LC display operating with a pulse-width modulated (PWM) waveform, the issue is further complicated in that digital displays quantize time and thus may only change the modulation duration in discrete intervals. A need thus exists to better drive a display with digital modulation signals.

DETAILED DESCRIPTION

In various embodiments, a difference or delta between known points in an input video stream and a modulation stream may be measured. Using such a delta, a display may determine whether (and how) to update the modulation time of the modulation stream in the future. In such manner, DC balance of the display may be maintained.

Figure 1:
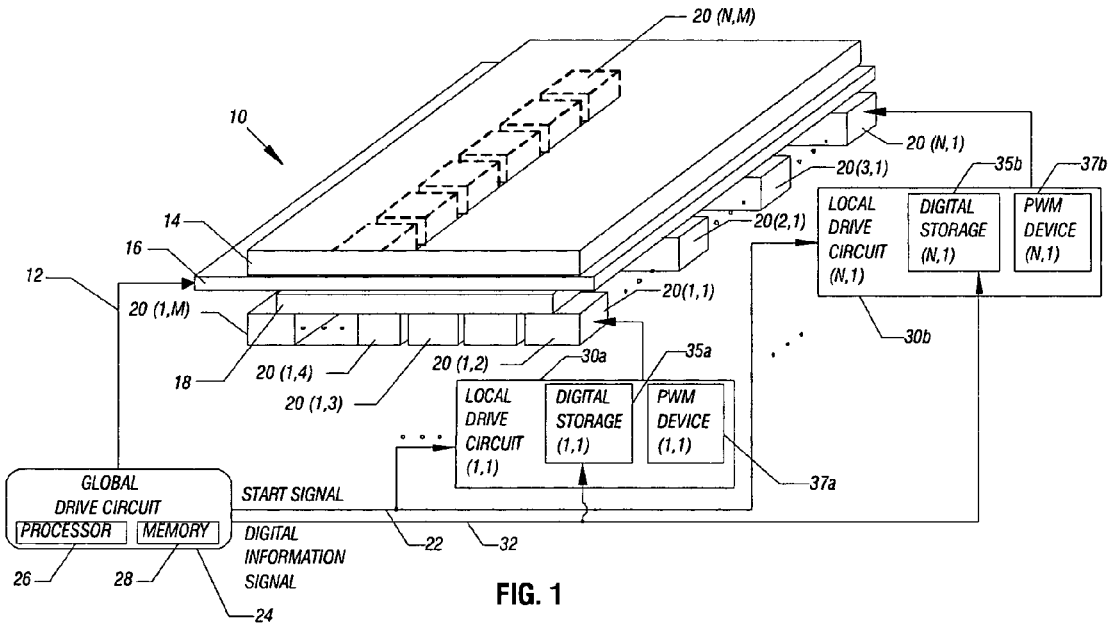
FIG. 1 is a block diagram of a display device in accordance with one embodiment of the present invention.

Referring now to FIG. 1, shown is a display system 10 (e.g., a liquid crystal display (LCD), such as a spatial light modulator (SLM)) that includes a liquid crystal layer 18 according to an embodiment of the present invention. In one embodiment, the liquid crystal layer 18 may be sandwiched between a transparent top plate 16 and a plurality of pixel electrodes 20(1, 1) through 20(N, M), forming a pixel array comprising a plurality of display elements (e.g., pixels). In some embodiments, the top plate 16 may be made of a transparent conducting layer, such as indium tin oxide (ITO). Applying voltages across the liquid crystal layer 18 through the top plate 16 and the plurality of pixel electrodes 20(1, 1) through 20(N, M) enables driving of the liquid crystal layer 18 to produce different levels of intensity on the optical outputs at the plurality of display elements, i.e., pixels, allowing the display on the display system 10 to be altered. A glass layer 14 may be applied over the top plate 16. In one embodiment, the top plate 16 may be fabricated directly onto the glass layer 14.

A global drive circuit 24 may include a processor 26 to drive the display system 10 and a memory 28 storing digital information including global digital information indicative of a common reference and local digital information indicative of an optical output from at least one display element, i.e., pixel. In some embodiments, the global drive circuit 24 applies bias potentials 12 to the top plate 16. Additionally, the global drive circuit 24 may provide a start signal 22 and a digital information signal 32 to a plurality of local drive circuits (1, 1) 30*a* through (N, 1) 30*b*, each of which may be associated with a different display element being formed by the corresponding pixel electrode of the plurality of pixel electrodes 20(1, 1) through 20(N, 1), respectively.

In one embodiment, a LCOS technology may be used to form the display elements of the pixel array. Liquid crystal devices formed using the LCOS technology may form large screen projection displays or smaller displays (using direct viewing rather then projection technology). Typically, the LC material is suspended over a thin passivation layer. A glass plate with an ITO layer covers the liquid crystal, creating the liquid crystal unit sometimes called a cell. A silicon substrate may define a large number of pixels. Each pixel may include semiconductor transistor circuitry in one embodiment. However, in other embodiments other digital modulation schemes and devices, for example, a digital light processor (DLP), such as a microelectromechanical systems (MEMS) device (e.g., a digital micromirror device) may be used.

One technique in accordance with an embodiment of the present invention involves controllably driving the display system 10 using pulse-width modulation (PWM). More particularly, for driving the plurality of pixel electrodes 20(1,1) through 20(N, M), each display element may be coupled to a different local drive circuit of the plurality of local drive circuits (1, 1) 30*a* through (N, 1) 30*b*, as an example. To hold and/or store any digital information intended for a particular display element, a plurality of digital storage (1, 1) 35*a* through (N, 1) 35*b* may be provided, each of which may be associated with a different local drive circuit of the plurality of local drive circuits (1, 1) 30*a* through (N, 1) 30*b*, for example. As discussed further below, such digital information may be used to determine a transition within a PWM waveform.

For generating a pulse-width modulated waveform based on the respective digital information, a plurality of PWM devices (1, 1) 37*a* through (N, 1) 37*b* may be provided in order to drive a corresponding display element. In one case, each PWM device of the plurality of PWM devices (1, 1) 37*a* through (N, 1) 37*b* may be associated with a different local drive circuit of the plurality of local drive circuits (1, 1) 30*a* through (N, 1) 30*b*.

Consistent with one embodiment of the present invention, the global drive circuit 24 may receive video data input and may scan the pixel array in a row-by-row manner to drive each pixel electrode of the plurality of pixel electrodes 20(1,1) through 20(N, M). Of course, the display system 10 may comprise any desired arrangement of one or more display elements. Examples of the display elements include spatial light modulator devices, emissive display elements, non-emissive display elements and current and/or voltage driven display elements.

Figure 2:
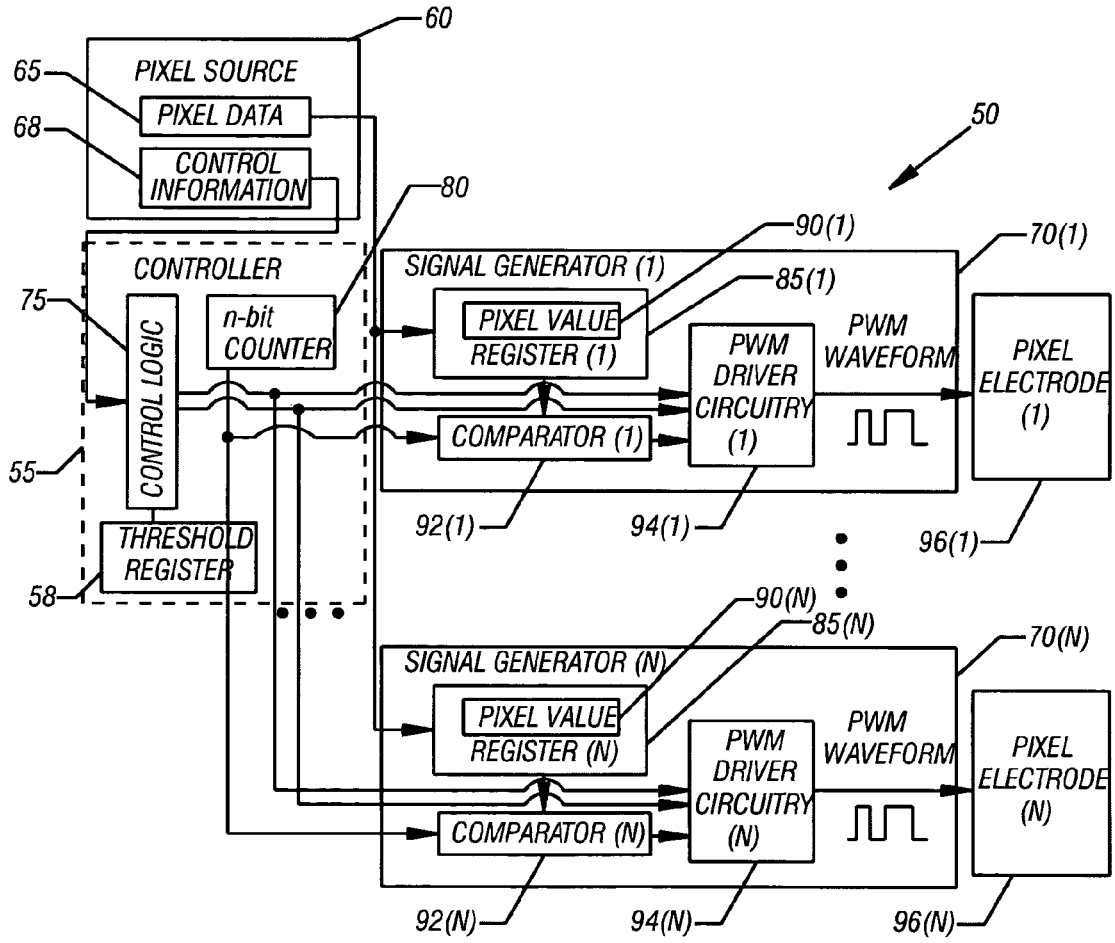
FIG. 2 is a block diagram of a display controller and display array in accordance with one embodiment of the present invention.

Following the general architecture of the display system 10 of FIG. 1, a SLM 50 shown in FIG. 2 includes a controller 55 to controllably operate SLM 50. For the purposes of storing digital information, SLM 50 may further include a pixel source 60. The pixel source 60 stores pixel data 65 comprising digital information that may include global digital information and local digital information in accordance with one embodiment of the present invention. As further shown in FIG. 2, pixel source 60 may also store control information 68. Such control information may include, for example, timing and other control information as may be included in a vertical blanking interval (VBI) or other portion of a video frame. As shown, control information 68 may be provided to a control logic 75 of controller 55.

Although the scope of the present invention is not limited in this respect, pixel source 60 may be a computer system, graphics processor, digital versatile disk (DVD) player, and/or a high definition television (HDTV) tuner. In addition, pixel source 60 may not provide pixel data 65 for all of the pixels in the display system 10. For example, pixel source 60 may simply provide the pixels that have changed since the last update since in some embodiments having appropriate storage for all the pixel values, it will ideally know the last value provided by the pixel source 60.

SLM 50 may further comprise a plurality of signal generators 70(1) through 70(N), each associated with at least one display element. Each signal generator 70 may be operably coupled to controller 55 for receiving respective digital information. When appropriately initialized, each signal generator 70 may determine a transition in a PWM waveform based on the digital information to drive a different display element. It is to be understood that while the signal generators of FIG. 2 are shown with the specific components shown therein, the scope of the present invention is not so limited, and in other embodiments a signal generator may have different configurations.

As shown in FIG. 2, in one embodiment, controller 55 may incorporate control logic 75 and a counter 80 (e.g., n-bit wide). The control logic 75 may controllably operate each display element based on respective digital information. To this end, counter 80 may provide global digital information indicative of a dynamically changing common reference, i.e., a count, to each display element.

Further, control logic 75 may receive control information 68 from pixel source 60 and use at least some portion thereof in controlling the PWM waveform. For example, control logic 75 may analyze control information 68 to determine a video rate of pixel data 65 that may be provided to signal generators 70(N) in the form of a video stream. As will be discussed below, the video rate may jitter over time, leading to a video stream having frames of (at least marginally) different durations. Controller 55 may also include a threshold register 58 to store a threshold, as will be discussed below.

Pulse-width modulation may be utilized for generating color in an SLM device in an embodiment of the present invention. This enables pixel architectures that use pulse-width modulation to produce color in SLM devices. In this approach, the LC material may be driven by a signal waveform whose "ON" time is a function of the desired color value.

Figure 3:
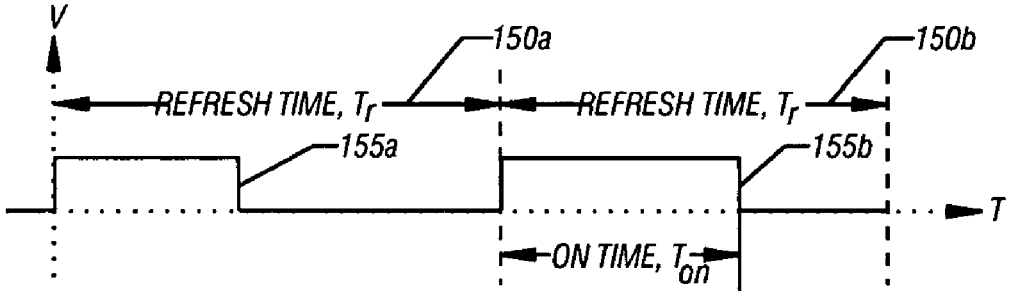
FIG. 3 is a hypothetical graph of applied voltage versus time for a spatial light modulator (SLM) in accordance with one embodiment of the present invention.

A hypothetical graph of an applied voltage versus time, i.e., a drive signal (e.g., a PWM waveform) is shown in FIG. 3 for a spatial light modulator in accordance with one embodiment of the present invention. Within a first refresh time period, $T_r$, 150*a*, the drive signal includes a first transition 155*a* and during the next cycle, i.e., within a second refresh time period, $T_r$, 150*b*, the drive signal includes a second transition 155*b*. The drive signal may be applied to pixel electrode 96(1) of FIG. 2, for example. Each transition of the first and second transitions 155*a*, 155*b*, separates the drive signal into a first and second pulse interval. The first pulse interval of the second refresh time period 150*b* is indicated as the "ON" time, $T_{on}$, as an example.

In some embodiments, the "ON" time, $T_{on}$, of the drive signal of FIG. 3 is a function, $f_{pwm}$, of the current pixel value, p, where $p \in [0, 2^n-1]$, n is the number of bits in a color component (typically 8 for some computer systems), $T_{on}$, $\in [0, T_r]$, and $T_r$ is a constant refresh time. For example, if $f_{pwm}$, is linear, then $T_{on}$ may be given by the following equation:

$$T_{on} = f_{pwm}(p) = \frac{p}{2^n - 1} T_r \tag{1}$$

The first and second refresh time periods, i.e., $T_r$, 150*a* and 150*b*, may be determined depending upon the response time, i.e., $T_{resp}$, of the LC material along with an update rate, i.e., $T_{update}$, (e.g., the frame rate) of the content that the display system 10 (FIG. 1) may display when appropriately driven. Ideally, the refresh time periods, i.e., $T_r$, 150*a* and 150*b* may be devised to be shorter than that of the update rate, $T_{update}$, of the content, and the minimum "ON" time ($T_{on}$), may be devised to be larger than the response time, $T_{resp}$, of the LC material. However, $T_{on}$ may be time varying as a pixel value "p" may change over time.

Referring back to FIG. 2, in one embodiment, controller 55 may operate as follows. In step 1, control logic 75 may present a "start" signal (e.g., the start signal 22 of FIG. 1) to each PWM driver circuitry (N) 94, which may generate a corresponding PWM waveform for the attached pixel at each pixel electrode (N) 96. In step 2, each PWM driver circuitry (N) 94 in each pixel turns its output "ON" in response to the "start" signal.

The n-bit counter 80 (where "n" may be the number of bits in a color component) may begin counting up from zero at a frequency given by $2^n/T_r$ in step 3. In step 4, each pixel monitors the counter value using comparator circuit 92 (N) that compares two n-bit values, i.e., the counter and pixel values "c," "p" for equality. An n-bit register 85 (N) may hold the current pixel value for each pixel. When a pixel finds that the counter value "c" is equal to its pixel value "p," the PWM driver circuitry 94 (N) turns its output "OFF." This process repeats in an iterative manner by repetitively going back to the step 1 based on a particular implementation.

While the above process may be implemented in a display in accordance with an embodiment of the present invention, additional processing may occur in certain instances. For example, as will be discussed further below, if the duration of a video frame differs from that of a corresponding modulation frame (for example, based on the counter value), the duration of future modulation frames may be changed. In such instances, control logic 75 may provide an additional signal (i.e., a modification signal) to signal generator 70(N) to change the duration of the PWM waveform. For example, such a modification signal may be sent to driver circuitry 94(N) to cause the resulting PWM waveform (e.g., its refresh period) to be modified. This modification signal may change the duration of the PWM waveform by adding or subtracting clock cycles from the refresh period. The number of such cycles may depend upon the difference between the video frame length and corresponding modulation frame length.

This difference or delta between known points in an input video stream and a modulation stream may be measured, and used to determine whether (and how) to update the modulation time in the future. In such manner, DC balance of the display may be maintained.

Figure 4:
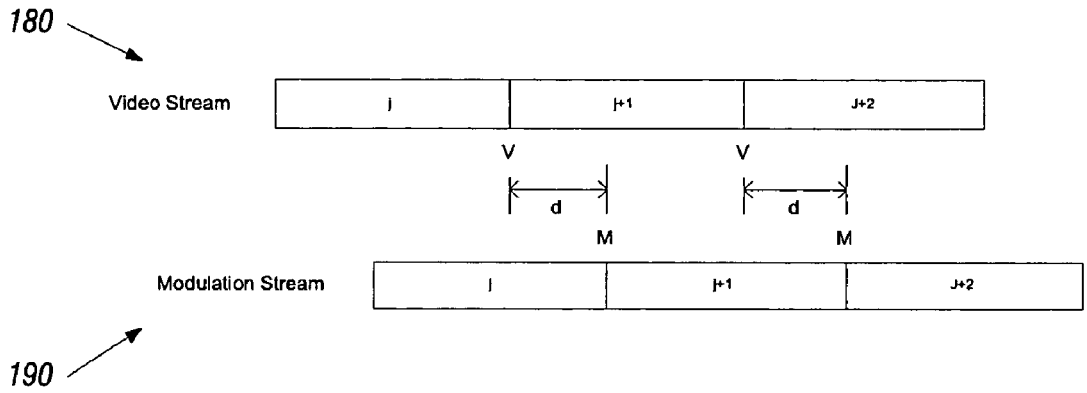
FIG. 4 is a graphical representation of hypothetical video streams and modulation streams in accordance with one embodiment of the present invention.

Referring to FIG. 4, point V in a video stream 180 may correspond to a known, repetitive point in video stream 180 (e.g., the vertical blanking interval for a frame), while point M of modulation stream 190 may correspond to a known, repetitive point in modulation stream 190 (e.g., the start of the modulation for a frame). While not drawn to scale, FIG. 4 shows that the number of cycles between subsequent V points is not constant. Accordingly, video frames J, J+1 and J+2, may all be of different lengths (e.g., in terms of cycles), in certain embodiments. Typically, the number of cycles between these points may be $n \pm \Delta$ where n is a fixed nominal value and $\Delta$ is a small time-varying value.

In an embodiment in which the modulation time is always fixed, there is some ideal relationship between M and V (represented as d in FIG. 4). A difference or delta in this relationship may thus be measured. Then, through feedback based on the delta, the time between adjacent M points in modulation stream 190 may be adjusted. In such manner, the modulation duration may be effectively changed in an effort to bring M and V back into a desired alignment (e.g., an equal "d" value).

For example, in one embodiment assume that the desired alignment is M=V and that the video and modulation streams are in this alignment for some frame j. Next, assume that in frame j+1, the frame duration increases by 2 cycles. For this frame M will arrive 2 cycles before V at the end of frame j+1. As a result, the display may increase the time between M points of future modulation frames by 2 cycles to try to close the gap between the video stream and modulation stream.

Figure 5:
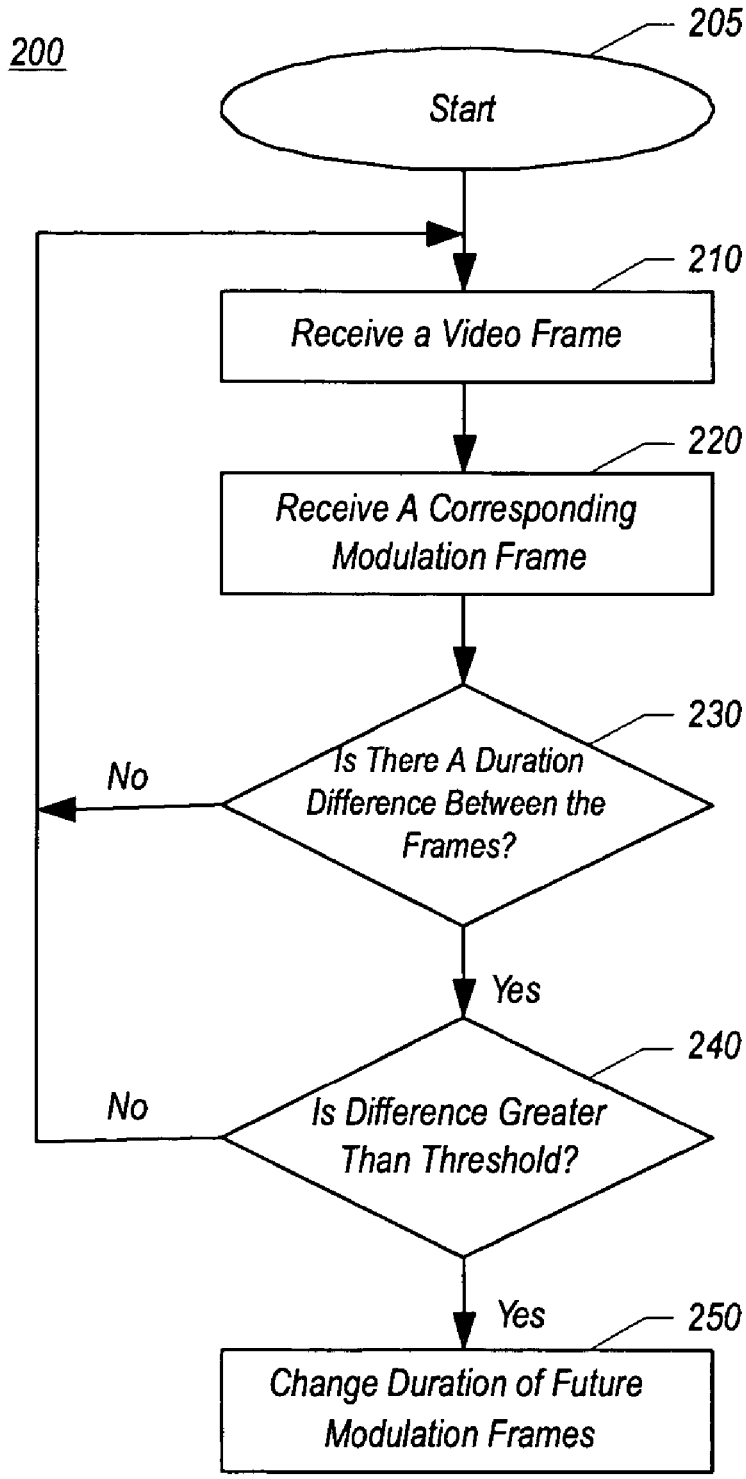
FIG. 5 is a flow diagram of a method in accordance with one embodiment of the present invention.

Referring now to FIG. 5, shown is a flow diagram of a method in accordance with one embodiment of the present invention. More specifically, as shown in FIG. 5, method 200 may be used to modify a duration of modulation frames in an effort to maintain a desired alignment between a video stream and a modulation stream. As shown in FIG. 5, method 200 may begin at a starting location (oval 205). Such a starting location may be at a beginning of a video stream to be displayed on a display device, such as a LCOS display. The video stream may be obtained from a pixel source, such as pixel source 60 of FIG. 2. Then the video stream may be provided to signal generator 70(N) of FIG. 2 as pixel data 65. In other embodiments, pixel data 65 may be provided to a display controller, such as controller 55 of FIG. 2, where the video stream may be converted to a modulation stream.

Still referring to FIG. 5, a video frame of the video stream may be received, for example, by control logic (block 210). Further, a corresponding modulation frame may also be received (block 220). Next, at diamond 230, it may be determined whether there is a duration difference between the modulation frame and the video frame. Such a duration difference may occur because of a variance in the length of a video frame. The difference may be determined by analyzing known points in both the modulation stream and the video stream to determine whether the difference exists. For example, a repetitive point in a video frame, such as the VBI may be compared to a known point in the modulation stream, for example, the start of a modulation frame. Thus by determining a relationship between these known points, which may be measured in a number of cycles, it may be determined whether the relationship changes over time, indicative of a duration difference between the frames.

If no such difference is present, control may return to block 210 for further processing at the next video and modulation frames. If instead it is determined at diamond 230 that a difference does exist, control may pass to diamond 240. There it may be determined whether the difference in duration between the video frame and modulation frame is greater than a threshold (diamond 240). For example, the threshold may be stored in threshold register 58 of controller 55 (of FIG. 2). In some embodiments, the threshold may be system selectable or user selectable. If the difference is not greater than the threshold, control may return to block 210 for further processing, as discussed above.

If instead it is determined at diamond 240 that the difference is greater than the threshold, control may pass to block 250. There, the duration of future modulation frames may be changed (block 250). For example, in one embodiment, the length of modulation frames may be changed by an increase in the duration difference between video and modulation frames determined above in diamond 230. It is to be understood that in various embodiments, method 200 may be continuously performed as video streams and modulation streams pass through the system.

In other embodiments, different algorithms may be chosen. For example, a moving average of the difference in the relationship between modulation and video streams (e.g., M to V deltas) may be obtained and used to determine changes to a length of the modulation frames.

In such manner, changes to a length of the modulation stream may be made to preserve DC balance. That is, such changes may ensure that even though the modulation time is dynamic, the DC balance constraint may be met. By maintaining DC balance in an LC material, performance may be improved and the lifetime of an LC-based microdisplay may be extended.

In various embodiments, a hardware or software mechanism may be used to measure the relationship between the streams. Similarly, hardware and/or software may be used to maintain the two asynchronous streams in substantial alignment (or at least a substantially steady relationship) with each other. In one embodiment, controller 55 of FIG. 2 may both measure the relationship and provide feedback information to change the duration of modulation frames. For example, in an embodiment such as that shown in FIG. 2, control logic may be present to determine when a difference exists between the duration of video frames and modulation frames.

With reference to FIG. 2, control logic 75 may control operation of the PWM waveform, and when a predetermined (or any) duration difference between video and modulation frames exists, control logic 75 may provide a signal to cause a change in future PWM waveform(s) to maintain a desired alignment between video frames and the modulation frames. However, it is to be understood that the scope of the present invention is not so limited, and in other embodiments, different mechanisms (e.g., in hardware or software) may be used maintain alignment.

For example, embodiments may be implemented in a computer program that may be stored on a storage medium having instructions to program a display system to perform the embodiments. The storage medium may include, but is not limited to, any type of disk including floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, magnetic or optical cards, or any type of media suitable for storing electronic instructions. Other embodiments may be implemented as software modules executed by a programmable control device.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

measuring a duration difference between a video frame and a corresponding modulation frame; and determining whether to change a duration of a future modulation frame based on the duration difference by comparing the duration difference to a stored threshold value and modifying the duration if the difference is greater than said threshold.

2. The method of claim 1, further comprising changing the duration of the future modulation frame.

3. The method of claim 2, further comprising changing the duration to change a relationship between a first point of a future video frame and a second point of the future modulation frame.

4. The method of claim 3, further comprising changing the relationship to move the relationship towards a predetermined alignment.

5. The method of claim 1, further comprising determining to change the duration if the duration difference is greater than a previously determined duration difference.

6. The method of claim 3, wherein the second point of the future modulation frame comprises a start of the future modulation frame.

7. The method of claim 1, further comprising measuring the duration difference in clock cycles.

8. The method of claim 1, further comprising determining to change the duration if the duration difference exceeds a threshold.

9. The method of claim 1, further comprising determining to change the duration if the duration difference is greater than a moving average of previously determined duration differences.

10. An apparatus comprising:

a controller to determine if a duration difference exists between a video frame and a corresponding modulation frame and to modify a duration of a future modulation frame if the duration difference exists;

a display element coupled to the controller to receive the future modulation frame;

a threshold register in the controller to store a threshold relating to duration difference; and said controller modifies the duration if the duration difference is greater than the threshold.

11. A system comprising:

a spatial light modulator having at least one pixel;

a controller to determine if a duration difference exists between a video frame and a corresponding modulation frame and to modify a duration of a future modulation frame if the duration difference exists;

a signal generator to provide a waveform corresponding to the future modulation frame to the at least one pixel;

a threshold register in the controller to store a threshold relating to duration difference; and said controller modifying the duration if the duration difference is greater than the threshold.

12. The system of claim 11, wherein the system comprises a liquid crystal on silicon device.

* * * * *